US010844631B2

(12) United States Patent
Trupiano

(10) Patent No.: US 10,844,631 B2
(45) Date of Patent: Nov. 24, 2020

(54) PIN TUMBLER LOCK

(71) Applicant: Matthew Trupiano, Roseville, MI (US)

(72) Inventor: Matthew Trupiano, Roseville, MI (US)

( * ) Notice: Subject to any disclaimer, the term of this patent is extended or adjusted under 35 U.S.C. 154(b) by 54 days.

(21) Appl. No.: 16/104,985

(22) Filed: Aug. 20, 2018

(65) Prior Publication Data

US 2020/0056402 A1 Feb. 20, 2020

(51) Int. Cl.
*E05B 27/00* (2006.01)

(52) U.S. Cl.
CPC ..... *E05B 27/0067* (2013.01); *E05B 27/0007* (2013.01); *E05B 27/0017* (2013.01)

(58) Field of Classification Search
CPC ..... E05B 27/006; E05B 27/0064; E05B 27/0067; E05B 27/0007; E05B 27/0017; E05B 27/0071
USPC ..... 70/352, 419–421, 386
See application file for complete search history.

(56) References Cited

U.S. PATENT DOCUMENTS 1,656,854 A * 1/1928 Best ..... E05B 9/084 70/369
2,059,129 A * 10/1936 Maxwell ..... E05B 15/1614 70/493
2,814,941 A * 12/1957 Best ..... E05B 9/084 70/340
3,045,468 A * 7/1962 Welch ..... E05B 27/006 70/421
3,286,494 A * 11/1966 Sussina ..... E05B 27/0064 70/419
3,298,211 A * 1/1967 Russell ..... E05B 9/084 70/369
3,395,558 A * 8/1968 Russell ..... E05B 27/0053 70/493
3,928,993 A * 12/1975 Epstein ..... E05B 27/00 70/419
4,282,731 A * 8/1981 Taksony ..... E05B 27/0064 70/419
4,328,690 A * 5/1982 Oliver ..... E05B 9/086 70/369
4,377,940 A * 3/1983 Hucknall ..... E05B 15/1614 70/378
4,386,510 A * 6/1983 Best ..... E05B 9/084 70/369
4,577,479 A * 3/1986 Widen ..... E05B 27/006 70/378
4,655,063 A * 4/1987 Foshee ..... E05B 27/006 70/378
5,507,163 A * 4/1996 Juang ..... E05B 9/086 70/369
8,739,588 B2 * 6/2014 Burmesch ..... E05B 27/0017 70/378
10,337,210 B2 * 7/2019 Widen ..... E05B 27/0003
(Continued)

*Primary Examiner* — Suzanne L Barrett
(74) *Attorney, Agent, or Firm* — Raggio & Dinnin, P.C.

(57) ABSTRACT

A pin tumbler cylinder lock that is virtually pick proof comprises a cylinder housing having a single bore and a cylinder key plug arranged in the single bore. The pin tumbler cylinder lock also comprises a cavity having a predetermined shape in a predetermined portion of the housing. The pin tumbler cylinder lock also includes a lockout sleeve arranged over the cylinder key plug wherein the lockout sleeve may rotate within the cavity to create a lockout mode for the pin tumbler cylinder lock when a lock picking attempt is occurring thereon.

19 Claims, 9 Drawing Sheets

(56) References Cited

U.S. PATENT DOCUMENTS

| | | | | |
|---|---|---|---|---|
| 2008/0202181 | A1* | 8/2008 | Burmesch | E05B 27/0017 70/493 |
| 2008/0302150 | A1* | 12/2008 | Wu | E05B 27/0064 70/493 |
| 2015/0240525 | A1* | 8/2015 | Walls | E05B 27/0053 70/344 |

* cited by examiner

PIN TUMBLER LOCK

BACKGROUND OF THE INVENTION

1. Field of the Invention

The present invention generally relates to a pin tumbler cylinder lock and more particularly relates to a novel pick proof pin tumbler cylinder lock.

2. Description of Related Art

Pin tumbler locks have been known for many years in the prior art. Generally, a pin tumbler lock uses a key and that key has a set positioning for a plurality of tumblers arranged within the pin tumbler lock and holds those pin tumblers at a shear line arranged at an outer periphery of a cylinder key plug, thus allowing for the key and similar key plug to turn within the cylinder housing of the pin tumbler lock. This in turn may turn a cam or other device connected to the end of the cylinder key plug thus unlocking the door or other device being locked by the prior art pin tumbler lock. Similar locks are found on most if not all devices, such as doors, closets, safe boxes or any other device that uses a key lock therein. Generally, traditional pin tumbler locks may be pickable because rotational tension may be applied to the cylinder plug thereby permitting tumblers to be held in proper order when manipulating them so as to duplicate the permutation or combination of the pin tumblers of a correct key. Many of these prior art pin tumbler locks are capable of being picked by lock picking tools and instructions which are found in magazines, television, websites, YouTube, etc. Furthermore, the prior art also includes ready made lock picking tool sets or methods which are used to fabricate manual pick locking.

In view of these prior art methods of picking pin tumbler locks there is a need in the art for a simple and inexpensive lock mechanism that is virtually pick proof and is adaptable for general use. There also is a need in the art for a pin tumbler lock mechanism arranged within a conventional pin tumbler cylinder lock which may allow for a virtually pick proof lock, i.e., an anti-pick pin tumbler cylinder lock.

The prior art includes some high security cylinder locks that generally are virtually pick proof, but their cost and complexity prohibit their general use in the public. There is a need in the art for a simple and inexpensive cylinder lock that is virtually pick proof, thus satisfying the need for general use. Furthermore, many of these prior art security electronic key padlock sets require a mechanical key override and the present invention would fulfill a need for an inexpensive and secure pin tumbler lock that may equally exceed the best known key pad security. Generally, there also is a need in the art for a lock that may also function as a conventional pin tumbler lock type but renders the cylinder lock virtually pick proof due to the internal mechanism arranged therein that eliminates proper binding tension on pin tumblers which is a pre-condition for picking locks. There also is a need in the art for a low cost, easy to use and effective cylinder lock that is capable of being virtually pick proof while also capable of being retroactively placed into existing cylinder locks or easily manufactured into future cylinder locks. There also is a need in the art for an improved pin tumbler cylinder lock that uses a combination of a cylinder lock out sleeve and a plurality of ball bearings to create a virtually pick proof lock.

SUMMARY OF THE INVENTION

One object of the present invention may be to provide a novel and unique pin tumbler cylinder lock.

Another object of the present invention may be to provide a novel pin tumbler cylinder lock that may function as a conventional pin tumbler lock while also being virtually pick proof thereby achieving greater security with a minimum cost.

Yet another object of the present invention may be to provide a pin tumbler cylinder lock that is adaptable for padlocks, door locks, vending machines, safes and wherever higher security pin tumbler locks may be required or in any other lock situation.

Still another object of the present invention may be to provide a pin tumbler cylinder lock that may be used in conjunction with electronic key padlock sets that require mechanical key override to allow for an inexpensive and secure pin tumbler lock that would equal or exceed the key pad security thereof.

Still a further object of the present invention may be to provide a pin tumbler cylinder lock that is unable to be unlocked with any prior art lock picking device or tool and is pick proof even to one skilled in the art of locking picking.

Yet a further object of the present invention may be that it provides a pin tumbler cylinder lock that may be mastered keyed and may not interact with novel pick resistant mechanisms arranged within the cylinder lock.

Yet a further object of the present invention may be that it provides a pin tumbler cylinder lock that is capable of utilizing all possible permutations or key combinations irrespective of a novel pick resistant mechanism arranged within the cylinder lock.

According to the present invention, the foregoing and other objects and advantages are obtained for a novel design of a pin tumbler cylinder lock. The pin tumbler cylinder lock generally may be able to thwart any attempt that is made to pick the pin tumbler cylinder lock by turning the tension that is applied to the cylinder key plug, i.e., the rotational tension, such that the tension may only bind on tumblers in two of the six pin chambers within the pin tumbler cylinder lock. Furthermore, the tumblers in the two selected pin chambers must be picked before key plug rotation may be utilized to bind tumblers in the remaining four pin chambers. However, any rotational tension on the middle four tumblers is not allowable due to the use of a lock out sleeve and ball bearing arrangement which prohibits the rotational tension essential for lock picking. Therefore, the present pin tumbler cylinder lock only permits the lock out sleeve and the cylinder key plug to rotate together into a cavity of the cylinder housing wherein the cavity of the cylinder housing becomes a lock out chamber. Hence, the pin tumbler cylinder lock of the present invention may be set into a lock out mode thereby neutralizing any picking of the pin tumbler cylinder lock. It should be noted that normal pin tumbler cylinder lock function may be restored by reversing rotation of the cylinder key plug to the neutral position or lock mode.

One advantage of the present invention may be that it provides a novel and unique pin tumbler cylinder lock.

Another advantage of the present invention may be that it provides a pin tumbler cylinder lock that may function as a conventional pin tumbler lock with the advantage of being virtually pick proof thereby achieving greater security with a minimum cost.

Yet another advantage of the present invention may be that it provides a pin tumbler cylinder lock that may virtually replace any conventional pin tumbler cylinder lock of the prior art and is adaptable for padlocks, door locks, vending machines, safes, and wherever higher security pin tumbler locks may be required and in any other known locking situation or environment.

Still another advantage of the present invention may be that it provides a pin tumbler cylinder lock that is capable of being used in conjunction with a secure electronic lock set that requires a mechanical key override, therefore creating an inexpensive and secure pin tumbler lock assembly that may equal or exceed the security of the key padlock set.

Still another advantage of the present invention may be to provide a pin tumbler cylinder lock that cannot be unlocked with prior art lock picking device tools and is even pick proof by one skilled in the art of lock picking.

Still another advantage of the present invention may be to provide a pin tumbler cylinder lock that may be mastered keyed and may not interact with novel pick resistant mechanisms arranged within the cylinder lock.

Still another advantage of the present invention may be to provide a pin tumbler cylinder lock that is capable of utilizing all possible permutations or key combinations irrespective of pick resistant mechanisms arranged within the cylinder lock.

Still another advantage of the present invention may be to provide a pin tumbler cylinder lock that uses a lockout sleeve in combination with a ball bearing arrangement to create a virtual pick proof lock.

Still another advantage of the present invention may be to provide a pin tumbler cylinder lock that is low cost, easy to manufacture and is capable of being retro fitted into existing locks and easily manufactured into new locks.

Other objects, features and advantages of the present invention may become apparent from the subsequent description and appended claims taken in conjunction with the accompanying drawings.

BRIEF DESCRIPTION OF THE DRAWING(S)

DESCRIPTION OF THE EMBODIMENT(S)

Figure 1:
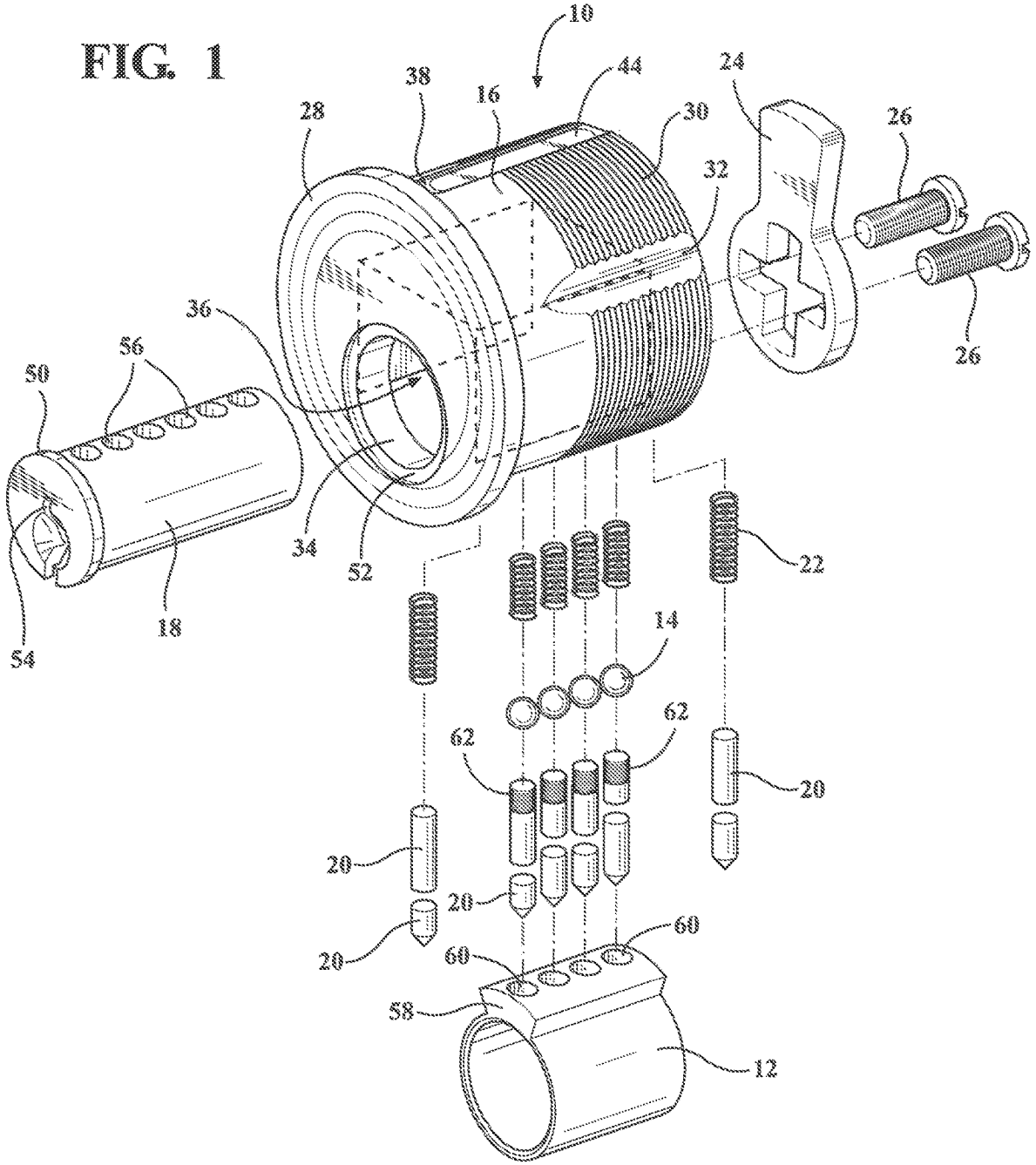
FIG. 1 shows an exploded view of a pin tumbler cylinder lock according to the present invention.
Figure 2:
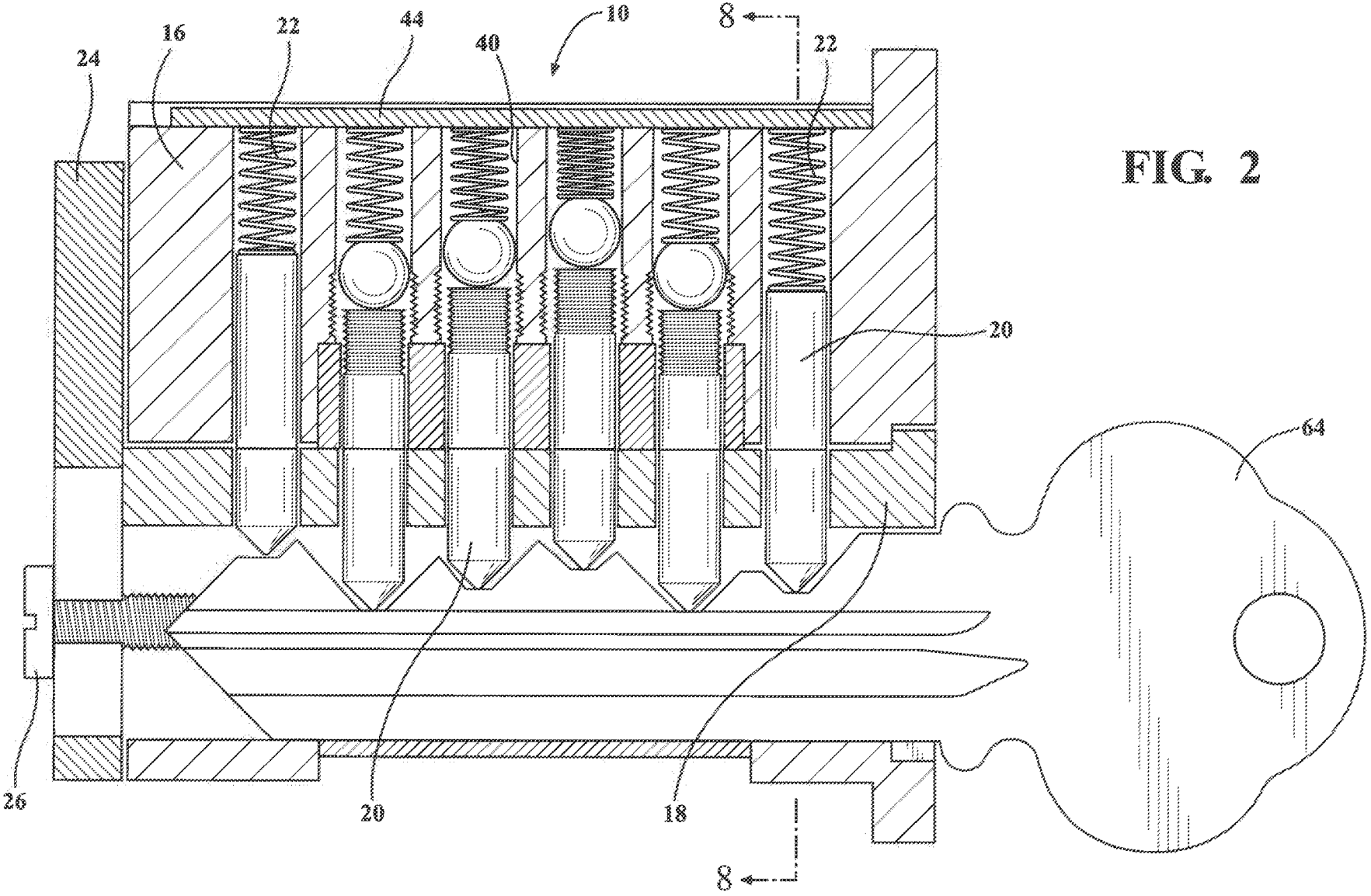
FIG. 2 shows a partial cross sectional view of a pin tumbler cylinder lock in the neutral or unlocked position according to the present invention.
Figure 3:
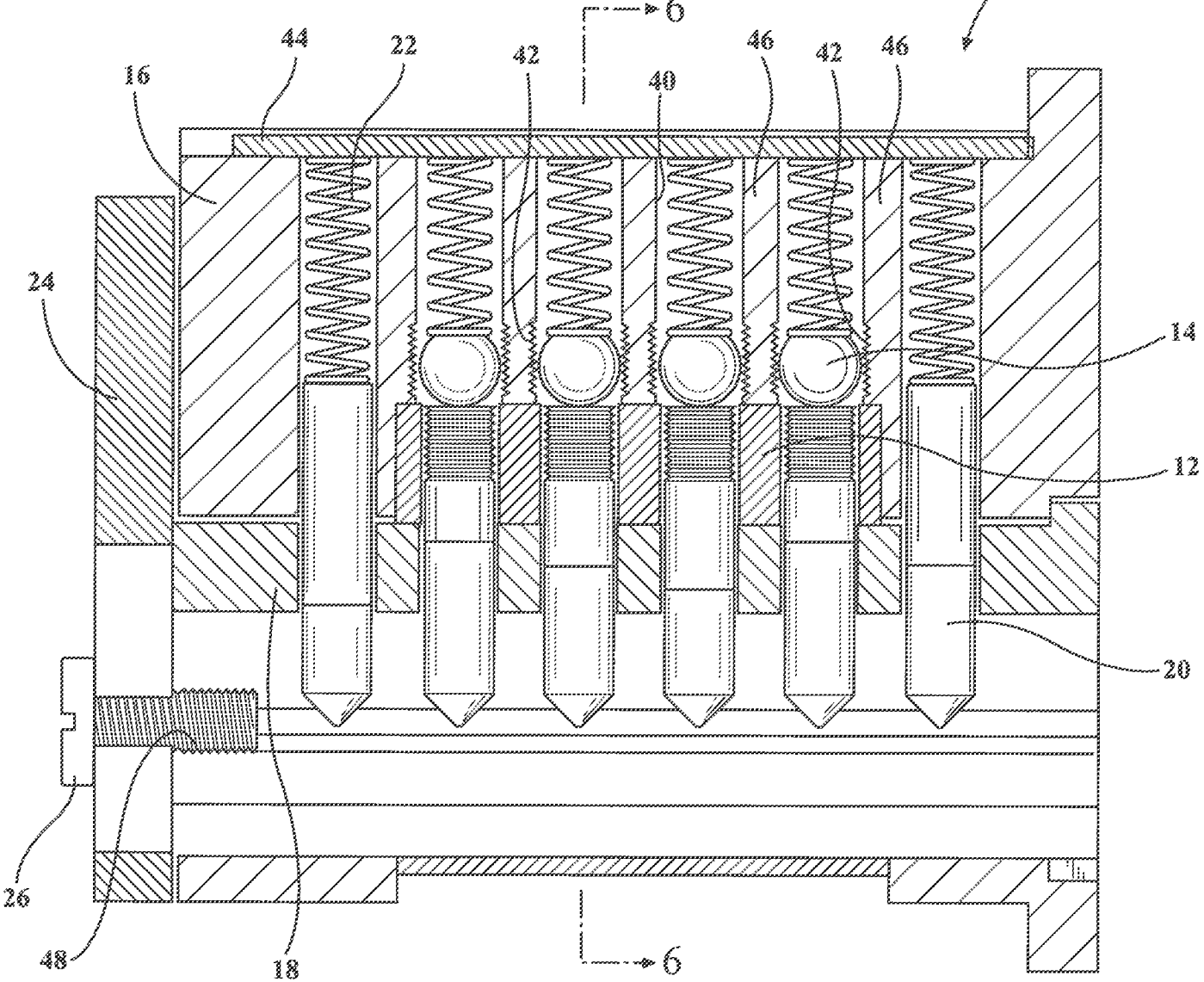
FIG. 3 shows a partial cross sectional view of a pin tumbler cylinder lock in a locked position according to the present invention.
Figure 4:
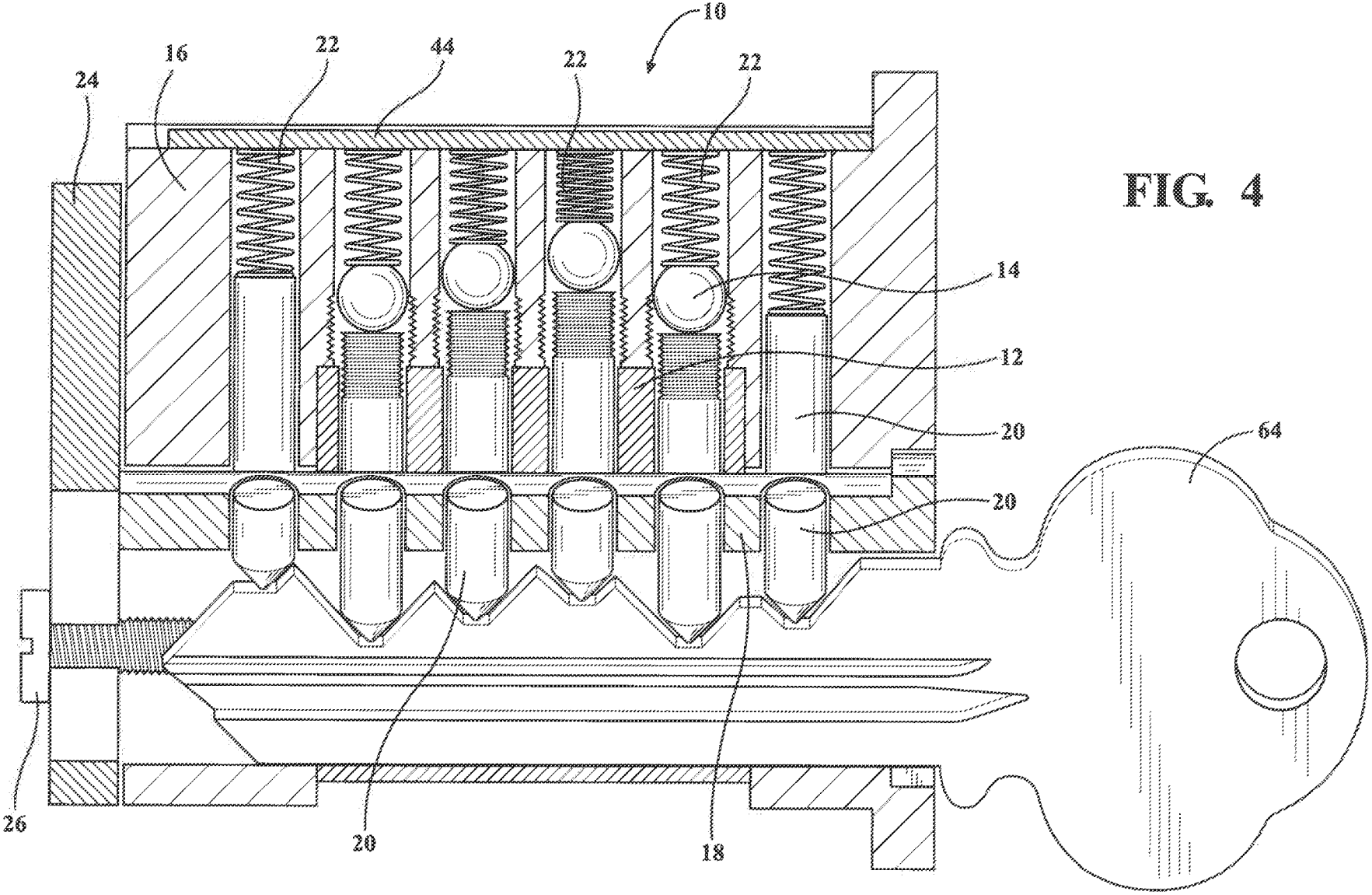
FIG. 4 shows a partial cross sectional view of a pin tumbler cylinder lock in an unlocked position according to the present invention.
Figure 5:
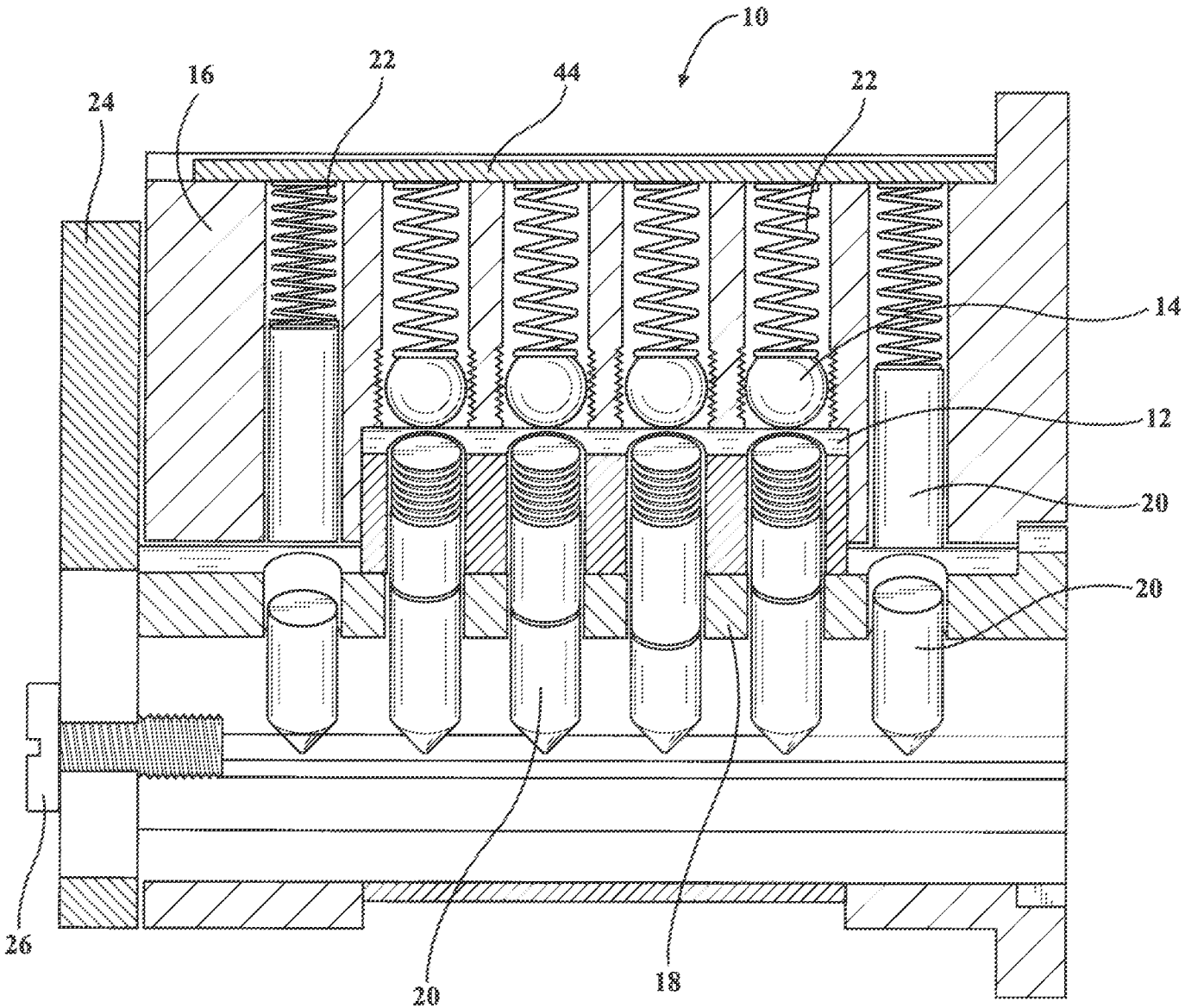
FIG. 5 shows a partial cross sectional view of a pin tumbler cylinder lock in lock out mode according to the present invention.
Figure 6:
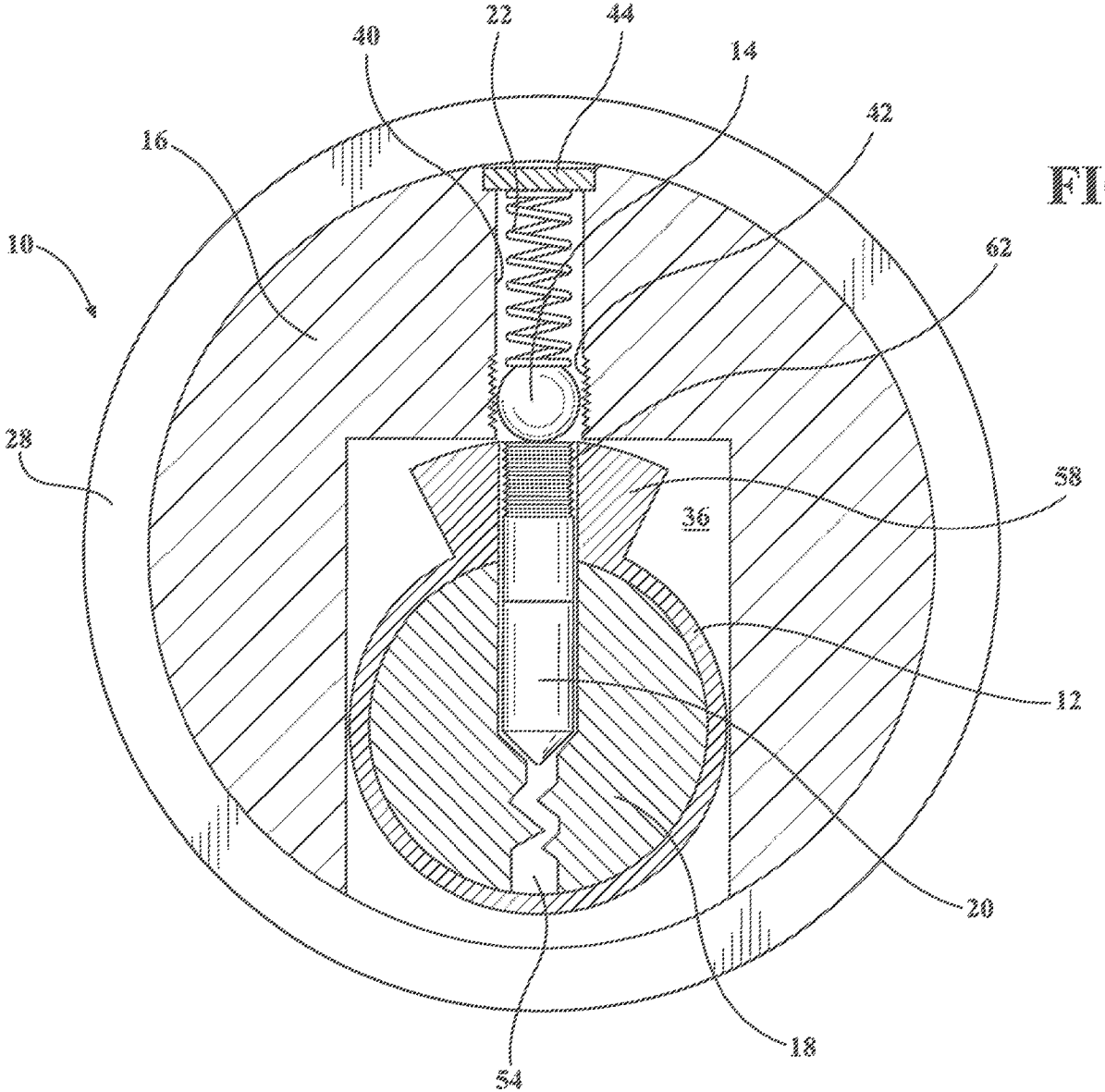
FIG. 6 shows a partial cross sectional view of the pin tumbler cylinder lock taken along line 6-6 of FIG. 3 according to the present invention.
Figure 7:
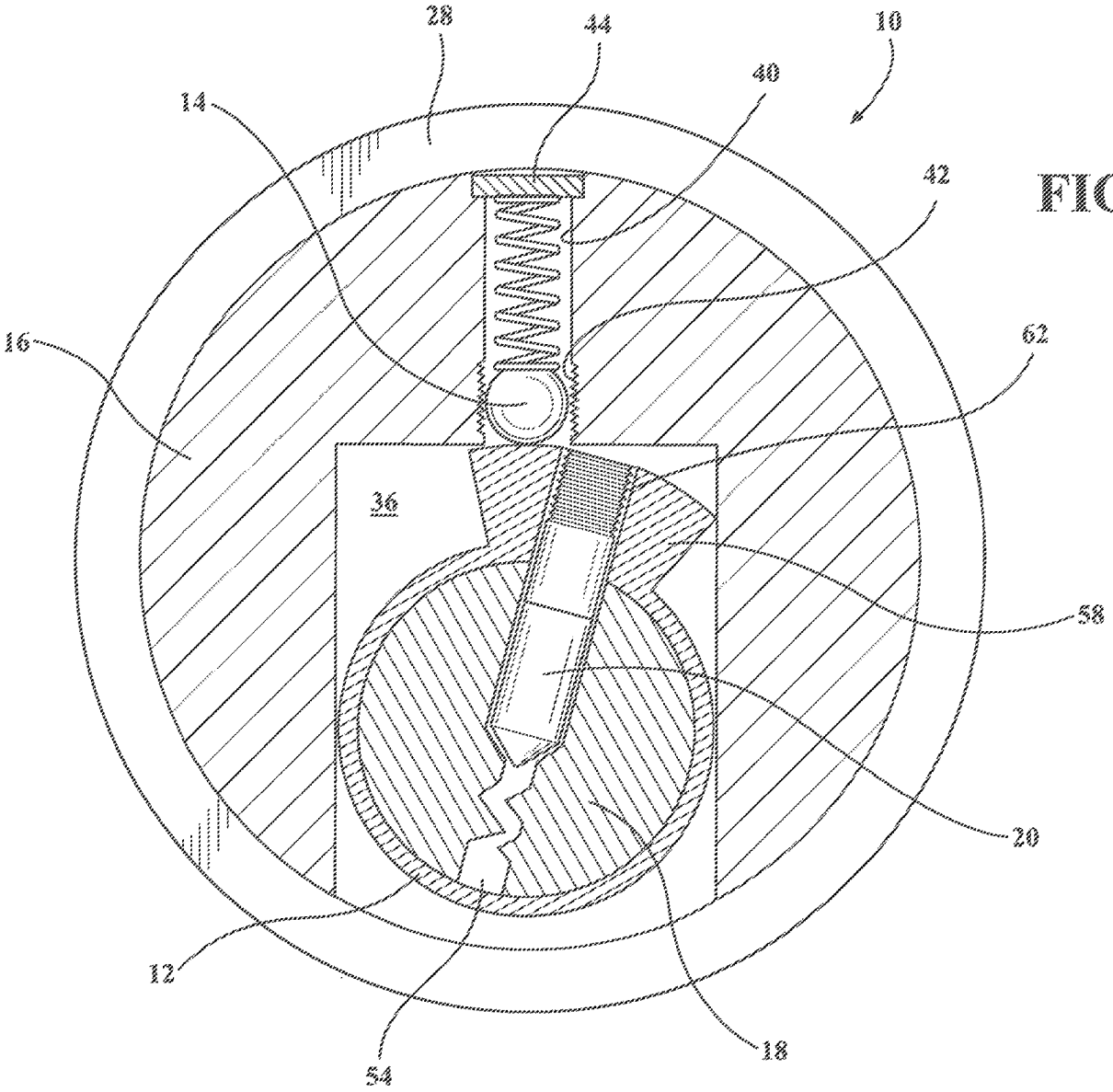
FIG. 7 shows a partial cross sectional view of the pin tumbler cylinder lock in lockout mode according to the present invention.
Figure 8:
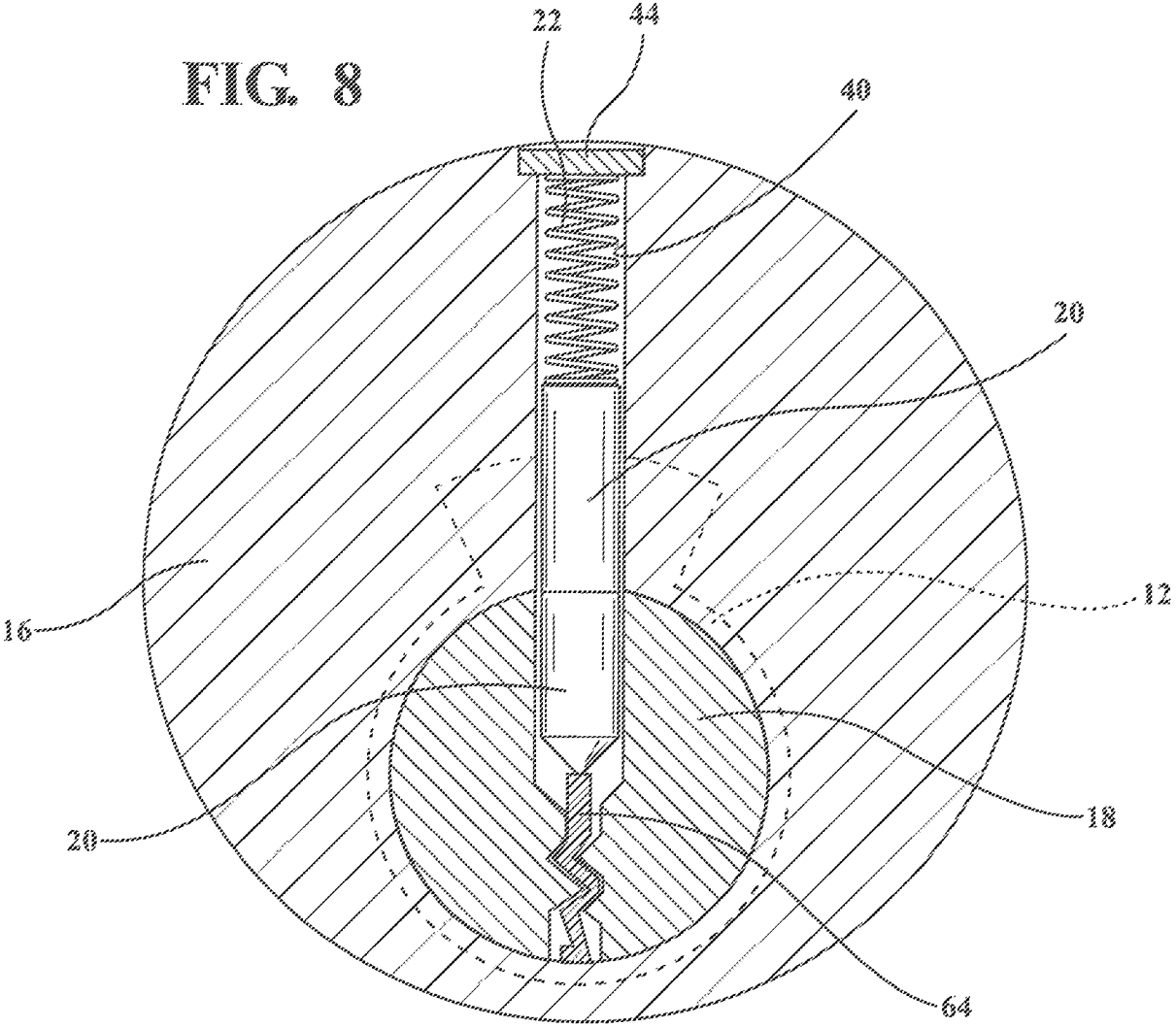
FIG. 8 shows a partial cross sectional view of a pin tumbler cylinder lock taken along line 8-8 of FIG. 2 according to the present invention.
Figure 9:
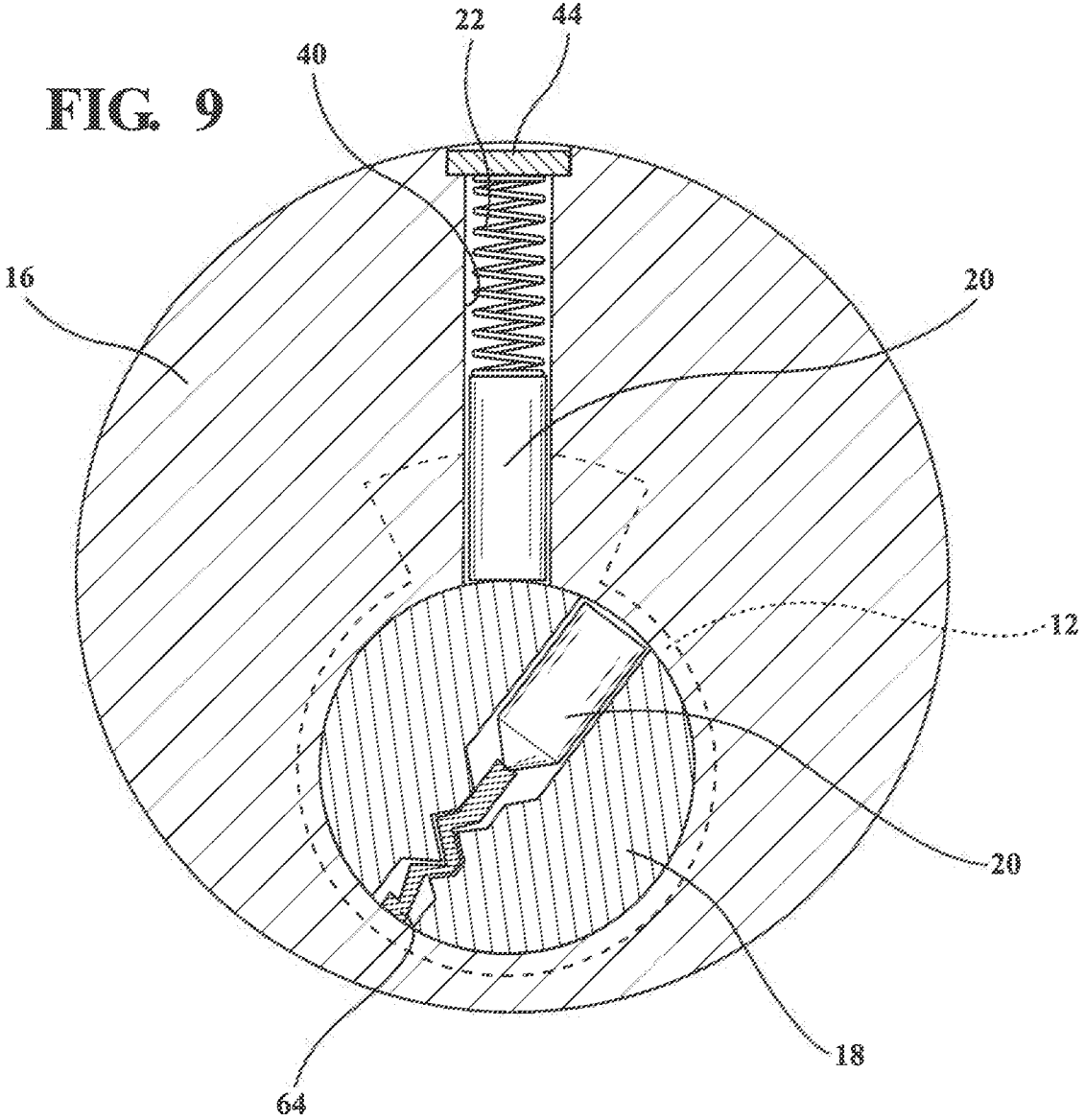
FIG. 9 shows a partial cross sectional view of a pin tumbler cylinder lock in an unlocked position according to the present invention.

Referring to the drawings, a pin tumbler cylinder lock 10 according to the present invention is shown. It should be noted that the pin tumbler cylinder lock 10 of the present invention is capable of being used both indoors and outdoors. It should further be noted that the pin tumbler cylinder lock 10 is capable of use in any known locking situation or environment, such as but not limited to padlocks, door locks, vending machines, safes and wherever high security pin tumbler locks are required or in any other known locking situation depending upon the design requirements. The pin tumbler cylinder lock 10 of the present invention generally is a practical pin tumbler cylinder lock that is virtually pick proof through the introduction of novel mechanisms arranged within the pin tumbler cylinder lock 10. In one case, a lockout sleeve 12 and ball bearing 14 arrangement are arranged therein thus allowing for a pick proof lock that is not capable of being picked by prior art picking mechanisms and by persons skilled in the art of lock picking. The pin tumbler cylinder lock 10 may function as a conventional pin tumbler lock mechanism, but may also render the pin tumbler cylinder lock 10 virtually pick proof through the use of a lock out sleeve 12 and ball bearing 14 arrangement arranged within the internal mechanisms of the pin tumbler cylinder lock 10. The use of the lock out sleeve 12 and ball bearings 14 may eliminate any proper binding tension that is necessary on pin tumblers for lock picking to occur. With the elimination of the binding tension, which is a precondition for picking locks, it makes the pin tumbler cylinder lock 10 of the present invention virtually pick proof. Generally, the pin tumbler cylinder lock 10 of the present invention may include a cylinder housing or cylinder lock housing 16, a cylinder key plug 18, a lockout sleeve 12, a plurality of tumblers 20, a plurality of springs 22, a plurality of ball bearings 14, and a cam 24 and necessary fasteners 26 to secure the cam 24 to the cylinder key plug 18. It should be noted that the cam 24 may be used to operate a bolt, a latch or any other locking mechanism associated with the pin tumbler cylinder lock 10. Therefore, any known pin tumbler cylinder lock in existence may be retro fitted with minor changes into the pick proof pin tumbler cylinder lock 10 of the present invention or any new pin tumbler cylinder lock 10 may be manufactured having the lock out sleeve 12 and ball bearing 14 arrangement placed directly therein.

The pin tumbler cylinder lock 10 of the present invention generally is shown in the Figures. The pin tumbler cylinder lock 10 includes a cylinder lock housing 16. The cylinder lock housing 16 generally has a cylindrical shape of any known dimension and it may include a circumferential flange 28 arranged on one end thereof. It should be noted that the cylinder housing 16 generally is made of a brass or iron material, however any other type of metal, ceramic, plastic, composite, or natural material may also be used to create the cylinder housing 16 of the present invention and all of the other components of the present invention. The cylinder housing 16 may also include a plurality of threads 30 arranged on an outer surface thereof. The threads 30 may extend a predetermined distance from the end of the cylinder housing 16 opposite the end with the circumferential flange 28. The cylinder housing 16 may also include at least one notch 32 arranged on an outer surface thereof, however it is also contemplated to create the cylinder housing 16 without any notches 32 or threads 30 arranged thereon. In the present embodiment, the notches 32 generally may have a triangular shape when viewed in cross section. It should further be noted that the cylinder housing 16 also may include a circular bore or circular inner bore 34 extending the entire length thereof. The circular inner bore 34 generally may have a predetermined diameter and may be arranged at or near a bottom surface of the cylinder housing 16. It should be noted that any other shape bore may be used other than the circular cylindrical inner bore, however the bore must be capable of allowing rotation therein to allow for the locking and unlocking of the pin tumbler cylinder lock 16 of the present invention. Therefore, in the preferred embodiment the single inner bore 34 has a circular or cylindrical shape and extends through the entire length of the cylinder housing 16. It should be noted that the inner bore may be located in any other position other than near the bottom of the cylinder housing 16 as shown in the drawings. The cylinder housing 16 of the present invention also may include a cavity or lock out cavity 36 arranged in an outer surface thereof. In the embodiment shown, the cavity 36 is arranged in the bottom surface of the cylinder housing 16 adjacent to the single inner bore 34 arranged through the length of the cylinder housing 16. It should be noted that the cavity 36 may have any known shape, however in one contemplated embodiment the cavity 36 may have a square or rectangular shape that extends a predetermined distance into the cylinder housing 16. It should be noted that the cylinder housing 16 is generally solid, however it is also contemplated to use a hollow cylinder to create the cylinder housing 16. It should be noted that the cavity 36 in the cylinder housing 16 may extend any known distance within the housing but generally may extend more than half way through the housing depending on the design requirements. It should further be noted that it may not extend even half way into the housing depending on the size of the cylinder key plug 18 arranged therein. The cavity 36 may include, but does not have to include, a plurality of circular areas arranged at each corner of the cylindrical cavity in one embodiment, however it is also contemplated to create the cavity 36 without having any type of cylindrical shaped area arranged at the corners of the generally square or rectangular cavity 36. It should be noted that the cavity 36 may be of any other shape other than square or rectangular depending on the design requirements of the pin tumbler cylinder lock 10. The cavity 36 may be arranged a predetermined distance from the front face and the back face of the cylinder housing 16. It may also be arranged a predetermined distance from each outer edge of the outer diameter of the cylinder housing 16 according to the present invention. It should be noted that any known size from a sixty fourth of an inch too many feet may be used for any of the dimensions of the pin tumbler cylinder lock 10 according to the present invention. It should be noted that the cavity 36 may be formed during manufacturing of the cylinder housing 16 or may be retro actively inserted into the bottom surface of an existing cylinder housing via any known manufacturing technique, such as drilling, sawing, routering, laser cutting or any other known mechanical or chemical technique for creating a cavity into a surface of a solid metal or other material. Therefore, the cavity 36 of the cylinder housing 16 may have a predetermined length and a predetermined width, which may be determined based on the environment and size of the pin tumbler cylinder lock 10. The cylinder housing 16 may also include a generally rectangular shaped channel 38 arranged along a top surface of the cylinder housing 16. The channel 38 may be directly opposite the midpoint of the cavity 36 arranged in the bottom surface of the cylinder housing 16. The channel 38 may have a predetermined depth into the outer surface of the cylinder housing 16. It should be noted that any known depth may be used for the channel 38 and any other known shape may be used for the channel other than rectangular as shown in the drawings.

Arranged within the channel 38 may be a plurality of orifices or pin chambers 40 that extend a predetermined distance into the cylinder housing 16. Generally, in one contemplated embodiment, there may be a total of six circular orifices 40 arranged within the top channel of the cylinder housing 16. Generally, these orifices 40 may be arranged between the top outer surface of the cylinder housing 16 and either the inner bore 34 of the cylinder housing 16 or the cavity 36 of the cylinder housing 16 depending on the location of the orifices 40. The orifices 40 are commonly referred to as pin chambers 40. Hence, it should be noted that the plurality of pin chambers 40 in one preferred embodiment may be a total of six pin chambers 40 with the first and last pin chamber 40 being arranged between an outer surface of the cylinder housing 16 and the inner bore 34 of the cylinder housing 16 while the middle pin chambers 40 may be arranged between an outer surface of the cylinder housing 16 and the cavity 36 on the opposite end thereof. The pin chambers 40 may have a predetermined diameter wherein the diameter of the middle four pin chambers 40 may be slightly larger or bigger than the diameter of the outer two pin chambers 40. It should be noted that any known diameters from a sixty fourth of an inch to multiple inches may be used for the diameters of the pin chambers 40 according to the present invention. The first and last two or end pin chambers 40 may have a smooth inner bore the entire length thereof. The middle four pin chambers 40 may include a serrated or threaded lower 42 portion therein. In one contemplated embodiment, the threaded or serrated lower portion 42 of the four middle pin chambers 40 may extend a predetermined distance that generally may be equal to or slightly longer or shorter than the diameter of a ball bearing 14 arranged therein. It should be noted that it is also contemplated to use the four middle pin chambers 40 without the serrated lower portion 42 arranged therein and it is also contemplated to have the serrated portion extend the entire length or any other length of the middle four pin chambers 40 or even on the two end pin chambers 40. As noted above, the middle four pin chambers 40 may have a diameter that is larger than the two end pin chambers 40. The walls 46 between and at the ends of the pin chambers 40 may have different thicknesses, depending upon the design requirements and the environment in which the pin tumbler cylinder lock 10 may be used. It should be noted that the inner walls or a portion of the inner walls of the first and last pin chamber 40 and the two end walls of the lock out sleeve flange 58 are half sized walls in comparison to the middle walls thereof. The cylinder housing 16 may also include a spring cap 44 arranged within and secured within the channel 38 arranged on the top surface of the cylinder housing 16. The spring cap 44 may be made of any known metal or any other known material and may used to secure the springs 22 and ball bearings 14 within the pin chambers 40 of the cylinder housing 16. It should be noted that it is also contemplated to use any other known shape for the cavity 36 such as an arcuate shape that is arranged over a predetermined top portion of the inner bore 34 of the cylinder housing 16.

The pin tumbler cylinder lock 16 of the present invention also may include a cylinder key plug 18. The cylinder key plug 18 generally may have a cylindrical shape that is generally the same length or slightly smaller or longer than that of the cylinder housing 16. Arranged in one end of the cylinder key plug 18 may be a first and second orifice 48. Generally, these orifices 48 are circular in shape and may have threads arranged on an inside surface thereof. The threads are used to receive a fastener 26, such as a screw or any other type of fastener within the two end orifices 48 of the cylinder key plug 18 to allow for connection of a cam 24 or other locking device directly to the outer surface of the cylinder key plug 18. It should be noted that the cylinder key plug 18 generally may have a length that is slightly larger than the length of the cylinder housing 16 thus allowing for a cam 24 to be securely fastened to the outer end of the cylinder key plug 18 while also allowing for rotation with respect to the end of the cylinder housing 16. However, any other length cylinder key plug 18 including one that is slightly shorter, the same length, or much longer than the cylinder housing 16 may also be used. The cylinder key plug 18 on one end thereof may have a circumferential flange 50 extending around the outer periphery thereof. The circumferential flange 50 generally may mate with and inter engage with a circumferential cavity 52 arranged in a front face of the cylinder housing 16, wherein the circumferential cavity 52 forms a circumferential riding surface or shoulder that interacts with the circumferential flange 50 of the cylinder key plug 18 to allow for the cylinder key plug 18 to rotate within the cylinder housing 16 such that the front face of the cylinder housing 16 and the cylinder key plug 18 align with one another to create an aesthetically pleasing front flat face for the pin tumbler cylinder lock 10. The cylinder key plug 18 also may include a paracentric key way 54 arranged along an entire or partial length thereof. The paracentric key way 54 may obstruct easy accessibility to the tumblers 20 arranged within the pin tumbler cylinder lock 10 thus leading to an impediment for lock picking. It should be noted that any other type of key way may also be used in the cylinder key plug 18 of the present invention. It should be noted that the cylinder key plug 18 may have an outer diameter that is slightly less than the inner diameter of the inner bore 34 of the cylinder housing 16, thus allowing for free rotation between the cylinder housing 16 and the cylinder key plug 18. It is also contemplated to put a plurality of bearings or other rotational aids between the inner bore 34 of the cylinder housing 16 and the outer surface of the cylinder key plug 18. The cylinder key plug 18 also may include a plurality of circular orifices or pin chambers 56 arranged in a top surface thereof. The circular orifices 56 may extend from the outer surface of the cylinder key plug 18 into the key way 54 of the cylinder key plug 18. These circular orifices 56 may have a predetermined diameter that may generally match or be equal to the diameter of the two end pin chambers 40 of the cylinder housing 16. All of the orifices 56 through the top surface of the cylinder key plug 18 may have the same diameter.

The pin tumbler cylinder lock 10 of the present invention may also include a lockout sleeve 12. Generally, the lockout sleeve 12 has a hollow cylindrical shape. The lock out sleeve 12 may generally have a circular inner diameter that is generally slightly larger than or the same as the outer diameter of the cylinder key plug 18. The lockout sleeve 12 may have a predetermined thickness for its cylindrical wall. Arranged at a top portion of the lockout sleeve 12 may be an arcuate or any other shaped flange 58. The arcuate flange 58 may generally have a circular shape and extend in a predetermined arc along the upper surface of the lockout sleeve 12. It should be noted that the flange 58 may extend a predetermined distance from the top surface of the lockout sleeve 12 and extend a predetermined radial distance from the top point of the lockout sleeve 12 in both directions. It should be noted that any other shape may be used for the flange 58 other than an arcuate shape as shown in the drawings. The lockout sleeve 12 may have a predetermined length. Generally, the length may be less than the overall length of the cylinder key plug 18 and the length may generally be equal to or slightly less than the length of the cavity 36 arranged in the cylinder housing 16. This may allow the lockout sleeve 12 to be able to rotate with respect to the cylinder housing 16 within the cavity 36 arranged. The outer diameter of the lockout sleeve 12 generally may be equal to or slightly less than the width of the cavity 36 of the cylinder housing 16, thus allowing for rotational movement to occur by the lockout sleeve 12 and cylinder key plug 18 within the cavity or lockout chamber 36 of the pin tumbler cylinder lock 10 according to the present invention. The lockout sleeve 12 may also include a plurality of orifices or pin chambers 60 arranged through the flange 58 thereof. The orifices 60 may extend between the top surface of the flange 58 and an inner bore of the lockout sleeve 12. It should be noted that the orifices 60 generally may have the same diameter as the orifices 56 of the cylinder key plug 18 and the two end pin chambers 40 of the cylinder housing 16. Thus, the four middle pin chambers 40 along with the four orifices 60 through the lockout sleeve 12 and the orifices 56 through the top of the cylinder key plug 18 may form some or all of the entire pin chambers for the locking mechanism. The lock out sleeve 12 may have different sized walls arranged between the four orifices 60 then the end walls thereof. In one contemplated embodiment, an end wall may be half the size of a wall between two of the orifices 60. The lockout sleeve 12 may allow for a virtually pick proof lock by allowing for slight rotation of the cylinder key plug 18 in a left or right direction into a lock out mode thus keeping the lock 10 from being picked by any commercially available picking product or by a professional manual lock picker.

The pin tumbler cylinder lock 10 of the present invention also includes a plurality of two piece pin tumblers 20 arranged in the six pin chambers 40 of the pin tumbler cylinder lock 10. Generally, it should be noted that the pin tumblers 20 are broken or split into a top tumbler and a bottom tumbler wherein the top tumblers and bottom tumblers generally have different lengths or heights. The dissimilar heights on the bottom pin tumblers may designate the size of the correlated top pin tumblers so as to achieve a same total tumbler height within each given pin chamber 40. Therefore, the measurement of the pin tumblers 20 height to determined key bitting or combination of the lock cylinder is ineffective and cannot be decoded to produce a correct key. Therefore, generally the bottom pin tumblers 20 may have different lengths or heights and the top pin tumblers 20 may have corresponding lengths or heights, such that the total height of all six pin tumblers 20 may be or may not be the same for the lock 10. Both portions of the pin tumblers 20 may have a predetermined diameter. This diameter generally may include an outer diameter that is generally the same as or slightly smaller than the diameter of the orifices 56 arranged in a top surface of the cylinder key plug 18. Generally, the outer surfaces of the pin tumbler 20 bottom and top portions are smooth. One end of the bottom portion of the pin tumbler 20 may have a coned or conical shape, which allows for the pin tumblers 20 to move in a vertical or other predetermined direction along the surfaces of the key arranged in the key way 54 and to be placed in the correct position when the key is inserted to create an open or unlocked position for the pin tumblers 20 with relation to the pin tumbler cylinder lock 10. The two outer pin tumblers 20 arranged within the end pin chambers 40 may have a coil spring 22 arranged between a top end of the pin tumbler 20 and the spring cap 44. The coil spring generally 22 may have any known height and may have any known predetermined spring force or compression thus providing the necessary force between the spring cap 44 and the top surface of the top portion of the pin tumbler 20. It should be noted that arranged within the four middle pin chambers 40 may be a ball bearing 14. The ball bearing 14 generally has an outer diameter slightly less than the inner diameter of the middle four pin chambers 40 of the cylinder housing 16. As noted above, the diameter of the middle four pin chambers 40 is larger than the diameter of the outer two pin chambers 40 of the cylinder housing 16. Hence, the ball bearing 14 arranged in each of the four middle pin chambers 40 has a similar outer diameter or slightly smaller outer diameter than the diameter of the middle four pin chambers 40. Arranged above and in contact with the ball bearing 14 may also be a coil spring 22 that also contacts the spring cap 44 on the opposite end thereof. It should be noted that the length of the coil springs 22 arranged within the middle four pin chambers 40 generally may be less than the length of the coil springs 22 arranged in the outer two pin chambers 40. However, it is also contemplated that all of the pin chambers 40 have the exact same length springs depending on the design requirements and environment in which the pin tumbler cylinder lock 10 may be used. It should further be noted that the top end of the four pin tumblers 20 arranged in the middle four pin chambers 40 may include a serrated or threaded portion 62. In one contemplated embodiment, the top portion of the top pin tumblers 20 of the middle four pin chambers 40 may have serrations 62 that extend a predetermined distance such that predetermined distance also is the same as the distance that the serrated or threaded surface 42 is arranged within the bottom portion of the middle four pin chambers 40. This may be anywhere from a sixty fourth of an inch to many inches depending on the size of the two piece pin tumblers 20 arranged within the pin tumbler cylinder lock 10. Thus, interaction may occur between the serrated outer surface 62 of the pin tumblers 20 and the serrated inner orifice 42 of the middle four pin chambers 40 to ensure a pick proof lock in any picking situation. It should be noted that all of the components described herein generally are made of a brass or iron material, however any other metal, ceramic, plastic, composite or natural material may be used for any of the components and keys used in the pin tumbler cylinder lock 10 according to the present invention.

As noted above, the pin tumbler cylinder lock 10 of the present invention may be utilized within any pin tumbler lock known but particularly of the cylinder type as shown in the drawings. As noted above, the cylinder housing 16 includes a single inner bore 34 which is used to accept and secure a cylinder key plug 18 therein while also having a cavity or cutout 36 arranged within the cylinder housing 16 in order to receive and allow for a lockout sleeve 12 to rotate therein. The cylinder key plug 18 includes a predetermined keyway 54 that in one particular embodiment is a paracentric type keyway however any other known keyway may also be used to obstruct easy accessibility to the pin tumblers 20 so as to impede lock picking. It should be noted that the periphery of the cylinder key plug 18 and periphery of the lockout sleeve 12 form two independent divisional shear lines for the pin tumbler cylinder lock 10 according to the present invention. The first shear line arranged at the outer periphery of the cylinder key plug 18 functions to operate the cylinder lock 10 when a correct key is entered into the keyway 54. Wherein, the second shear line arranged at the outer periphery of the lockout sleeve 12 may function as to create an unpickable or lock out mode where a person is attempting to pick the pin tumbler cylinder lock 10. The pin tumbler 20 arranged in the first and last pin chambers 40 may achieve a specified tumbler height in both pin chambers and may function as a typical pin tumbler cylinder lock mechanism. The remaining four middle pin chambers 40, which have the enlarged diameter in the cylinder housing 16 and the serrated lower section 42 therein, use the dissimilarity in the height of the bottom tumblers to determine the size of the correlated top tumblers so as to achieve the same tumbler height within each of the middle four pin chambers 40. This arrangement functions as a means to place the lock 10 into an unpickable mode when someone is attempting to pick the lock. With the pin tumbler 20 arrays as shown in the middle four chambers 40 are at rest or the lock mode, i.e., the bottom pin tumblers 20 in the cylinder key plug 18 and the correlated serrated top pin tumblers 20 extending into the pin chambers 60 of the lockout sleeve 12 with a specified height producing depression at the second shear line for placement of the ball bearing 14 thereat. This thereby creates friction free rotational resistance at the second shear line resulting in the second shear line being compromised once rotational tension is applied to the integrated cylinder key plug 18 while lock picking is occurring, thereby permitting the cylinder key plug 18 and the lock out sleeve 12 to rotate together wherein the lockout sleeve 12 acts as a lockout stop for the pin tumbler cylinder lock 10 which may terminate into the lockout cavity 36 subsequently neutralizing any further picking of the pin tumbler cylinder lock 10. Therefore, it must be noted that the above scenario may only be realized when the pin tumblers 20 in the first and last pin chambers 40 have already been picked. Therefore, when rotational tension which is essential for lock picking, is applied to the key plug 18 this tension is placed only on the pin tumblers 20 in the first and last pin chambers 40, thus permitting picking of those first and last pin chambers 40 due to the correct diameter of the pin chambers 40. Wherein with the middle four pin chambers 40 in the cylinder housing 16 being of a larger diameter and having a friction free ball bearing 14 arranged therein may not permit rotational tension to be placed on the top portion of the serrated pin tumblers 20 arranged therein. Hence, counteracting the manipulation of the pin tumblers 20 in the middle four pin chambers 40. Therefore, to a person skilled in the art once the first and last pin tumblers 20 in the first and last pin chambers 40 are picked the lockout sleeve 12 and cylinder key plug 18 may rotate and terminate or contact against an inner wall of the lock out cavity 36 resulting in a lockout stage or mode for the pin tumbler cylinder lock 10. In the event that the middle four pin tumblers 20 may be permitted to bind through rotational tension, the result may be a serration lockup wherein the pin tumblers 20, due to the engagement of the serrated top tumblers 20 arranged therein, with the lower serrated 42 section of the middle four pin chambers 40 may prohibit movement of the pin tumblers 20 which is vital to lock picking. It should be noted that releasing the tension on the cylinder key plug 18 so as to regain movement of the pin tumblers 20 may permit all of the pin tumblers 20 in the first and last pin chambers 40 to revert to the rest position and consequently reset the cylinder lock 10 to its lock mode.

As shown in the figures when a correct key is inserted into the cylinder key plug 18 through the keyway 54 this may elevate the pin tumblers 20 in the first and last pin chambers 40 so that the top of the bottom pin tumblers 20 are level with the first shear line and in turn elevates the correlated top pin tumblers 20 into the chambers 40 of the cylinder housing 16. The four bottom pin tumblers 20 of the four middle pin chambers 40 are also elevated and level with the first shear line such that the top serrated pin tumblers 20 may be elevated through the lockout sleeve 12 into the middle four chambers 40 of the cylinder housing 16 thus creating a stationary mode for the lockout sleeve 12 with respect to the cylinder key plug 18. This stationary mode of the lockout sleeve 12 may permit the cylinder key plug 18 to rotate within the lockout sleeve 12 independent of the same resulting in an unlocked state of the cylinder key plug 18 and lock 10. It should be noted that the arrangement of the ball bearings 14 may not interact with correct key operation as they are moved up into the four middle pin chambers 40. When the key 64 is withdrawn the bottom pin tumblers 20, correlated top pin tumblers and the serrated top pin tumblers may drop into or towards the cylinder key plug 18 with the remaining top section of the pin tumblers 20 setting above the first shear line extending into the pin chamber 40 of the cylinder housing 16 and the serrated top pin tumblers 20 setting above the first shear line and extending into the lockout sleeve 12 terminating at the second shear line and depression which may be arranged at a top surface of the lockout sleeve 12, thereby interlocking the lockout sleeve 12 with the cylinder key plug 18. It should be noted that the interlocked unit of the cylinder key plug 18 and the lockout sleeve 12 may be held in alignment by the first and last pin tumblers 20, the arrangement of the ball bearings 14 and the position of the top pin tumblers 20 of the middle four pin chambers 40 resulting in a locked stage or mode of the cylinder key plug 18 culminating in a locked mode of the pin tumbler cylinder lock 10.

In operation, the periphery of the lockout sleeve 12 and the cylinder key plug 18 form independent divisional shear lines respectively as noted above. The pin tumbler cylinder lock 10 of the present invention having an integrated lockout sleeve 12 and the cylinder key plug 18 within the cylinder housing 16 allows the former to act as a means to prevent lock picking in conjunction with the ball bearing 14 arrangement arranged therein. This may allow the key plug to operate as a conventional pin tumbler cylinder lock 10 when a key is arranged therein. Also, the pin tumbler cylinder lock 10 of the present invention may have the middle four pin chambers 40 of the cylinder housing 16 over sized to receive a single oversized ball bearing 14 in each of those chambers 40. This may create a point of least resistant at the lockout sleeve 12 or second shear line when lock picking is attempted. However, the ball bearings 14 may not enter the chambers 60 of the lockout sleeve 12 due to their size being larger than the orifices or pin chambers 60 arranged through the lockout sleeve 12, but may permit rotation of the lockout sleeve 12 into the cavity or lockout cavity 36 creating an unpickable mode. Hence, the arrangement of the larger ball bearings 14 may not interact with the function of a correct key being placed within the keyway 54. It should further be noted that the cylinder housing 16 of the present invention having the first and last pin chambers 40 of a conventional diameter and size unlike the middle four oversized pin chambers 40 may become instrumental in creating a virtually pick proof cylinder lock due to the interaction of the dis-similarity therebetween. It should further be noted that having the top serrated pin tumblers 20 in the middle four pin chambers 60 of the lockout sleeve 12 when the correct key is utilized may allow the pin tumblers 20 to partly elevate into the middle four pin chambers 40 of the cylinder housing 16 thereby creating a stationary mode of the lockout sleeve 12 with respect to the cylinder key plug 18 thus the cylinder key plug 18 is free to rotate in this unlocked state. The rotation occurs between the lockout sleeve 12 and the cylinder key plug 18 such that the user of the lock 10 does not realize that the lockout sleeve 12 is arranged within the pin tumbler cylinder lock 10 unless picking of the lock is being attempted. Furthermore, the cylinder key plug 18 includes the paracentric type keyway 54 which may further obstruct easy accessibility to the tumblers to further impede locking picking by either a lock picking mechanism or a lock picking professional. Also, it should be noted that having the cutout cavity 36 arranged in the lower section of the cylinder housing 16 may act as a stop for the lockout sleeve 12 when it rotates with the cylinder key plug 18 into the cavity 36 when lock picking is attempted. Thus, a lockout mode may be created and in this mode it is literally impossible to pick the lock 10. However, it should be noted that normal cylinder function may be restored to the lock 10 by simply reversing rotation of the cylinder key plug 18 to the neutral position or locked mode thus allowing for all of the pin tumblers 20 to reach their neutral position.

The present invention has been described in an illustrative manner. It is to be understood that the terminology which has been used is intended to be in the nature of words of description rather than that of limitation.

Many modifications and variations of the present invention are possible in light of the above teachings. Therefore, within the scope of the appended claims, the present invention may be practiced otherwise than as specifically described.

What is claimed is:

1. A pin tumbler cylinder lock, said lock comprising:
- a cylinder housing having a single bore;
- a cylinder key plug arranged in said single bore;
- a cavity having a generally predetermined shape arranged in a portion of said housing;
- a plurality of pin chambers arranged in a top surface of said cylinder housing;
- a lockout sleeve arranged over said cylinder key plug and rotatably within said cavity, said lockout sleeve and said cylinder key plug rotates together in said cavity in a clockwise or counterclockwise direction only when a first and last pin tumbler of said plurality of pin tumblers have been picked, said lockout sleeve having a plurality of pin chambers with a smaller diameter than a diameter of said plurality of pin chambers of said cylinder housing; and
- a ball bearing arranged in a predetermined number of middle said plurality of pin chambers of said cylinder housing, said ball bearing having a diameter that is larger than said smaller diameter of said lockout sleeve pin chambers, said ball bearing cannot enter said lockout sleeve pin chambers.

2. The pin tumbler cylinder lock of claim 1 further comprising a first shear line arranged at a periphery of said lock out sleeve, said first shear line having friction free rotational resistance.

3. The pin tumbler cylinder lock of claim 1 further comprising a second shear line arranged at a periphery of said cylinder key plug.

4. The pin tumbler cylinder lock of claim 1 further comprising a two piece pin tumbler arranged in each pin chamber.

5. The pin tumbler cylinder lock of claim 4 wherein middle pin chambers of said plurality of pin chambers having a larger diameter then end pin chambers of said plurality of pin chambers.

6. The pin tumbler cylinder lock of claim 5 wherein said middle pin chambers having a lower section, said lower section having a serrated surface.

7. The pin tumbler cylinder lock of claim 6 wherein a top of said two piece pin tumblers in said middle pin chambers having a serrated outer surface on a top portion thereof.

8. The pin tumbler cylinder lock of claim 1 further comprising bottom pin tumblers having different heights.

9. The pin tumbler cylinder lock of claim 8 further comprising top pin tumblers having different heights, said bottom pin tumbler and said top pin tumbler having same total height as other said top and bottom pin tumblers in predetermined other pin chambers.

10. The pin tumbler cylinder lock of claim 1 wherein said cylinder key plug having a paracentric key way.

11. The pin tumbler cylinder lock of claim 1 wherein said lock out sleeve rotates in said cavity and contacts a surface of said housing when lock picking is attempted to create a reversible lock out mode.

12. A cylinder lock, said lock comprising:

a cylinder housing having a single bore;

a cylinder key plug arranged in said single bore;

a cavity arranged in a predetermined portion of said cylinder housing;

a plurality of pin chambers arranged in a top surface of said cylinder housing;

a lock out sleeve arranged over said cylinder key plug and rotatably within said cavity, said lockout sleeve having a plurality of pin chambers with a smaller diameter than a diameter of said plurality of pin chamber of said cylinder housing, said lock out sleeve and said cylinder key plug rotate together in said cavity in a clockwise or counterclockwise direction only when a first and last pin tumbler of said plurality of pin tumblers have been picked, said rotation creates a reversible lock out mode for the cylinder lock; and a ball bearing arranged in a predetermined number of middle said pin chambers of said cylinder housing, said ball bearing having a diameter that is larger than said smaller diameter of said lock out sleeve pin chambers, said ball bearing cannot enter said lock out sleeve pin chambers.

13. The cylinder lock of claim 12 wherein said plurality of pin chambers having six total said pin chambers.

14. The cylinder lock of claim 13 wherein four of said pin chambers are said middle pin chambers, said middle pin chambers having a diameter greater than a first and last pin chamber diameters, said middle pin chambers arranged between said top surface of said cylinder housing and said cavity, said first and last pin chambers arranged between said top surface of said cylinder housing and said single bore.

15. The cylinder lock of claim 14 wherein each of said middle pin chambers of said cylindrical housing having a ball bearing arranged therein.

16. The cylinder lock of claim 15 further comprising a two piece tumbler arranged in each pin chamber.

17. The cylinder lock of claim 16 further comprising a spring arranged in said pin chamber, said spring is arranged between a top tumbler and a spring cap of said cylinder housing of said end pin chambers, said spring is arranged between said ball bearing and said spring cap of said cylinder housing of said middle pin chambers.

18. The cylinder lock of claim 17 wherein said middle pin chambers having a serrated lower section and a top tumbler having a serrated outer surface on a portion thereof.

19. The cylinder lock of claim 12 wherein said cylinder key plug having a paracentric key way.

* * * * *